US006237319B1

(12) United States Patent
Amundsen et al.

(10) Patent No.: US 6,237,319 B1
(45) Date of Patent: May 29, 2001

(54) ADJUSTABLE WRISTBAND LINK

(75) Inventors: Samantha Amundsen, McKinney, TX (US); Fung Chi Sun, Hong Kong (HK); Dan Smith, McKinney, TX (US)

(73) Assignee: Fossil, Inc., Richardson, TX (US)

( * ) Notice: Subject to any disclaimer, the term of this patent is extended or adjusted under 35 U.S.C. 154(b) by 0 days.

(21) Appl. No.: 09/614,090

(22) Filed: Jul. 12, 2000

Related U.S. Application Data

(60) Provisional application No. 60/143,603, filed on Jul. 13, 1999.

(51) Int. Cl.[7] ..... F16G 15/04
(52) U.S. Cl. ..... 59/82; 59/80; 59/85
(58) Field of Search ..... 59/80, 82, 78, 59/85; D11/13; 63/4

(56) References Cited

U.S. PATENT DOCUMENTS

| | | | | |
|---|---|---|---|---|
| Re. 25,163 | | 4/1962 | Manne | 63/15.45 |
| 1,405,851 | | 2/1922 | Lewis . | |
| 1,626,139 | | 4/1927 | Kraysler . | |
| 1,750,786 | | 3/1930 | Roy . | |
| 1,830,187 | | 11/1931 | Bellavance . | |
| 1,943,733 | | 1/1934 | Kestenman | 59/85 |
| 3,837,163 | * | 9/1974 | Fujimori | 59/80 |
| 3,930,364 | * | 1/1976 | Wong | 59/80 |
| 4,269,026 | | 5/1981 | Bulle et al. | 59/82 |
| 4,606,732 | | 8/1986 | Lyman | 446/120 |
| 5,689,947 | | 11/1997 | Yoo | 59/80 |
| 5,806,343 | | 9/1998 | Yoo | 63/3.1 |
| 6,098,394 | * | 8/2000 | Hashimoto et al. | 59/82 |
| 6,101,842 | * | 8/2000 | Delacretaz | 63/4 |

* cited by examiner

*Primary Examiner*—David Jones
(74) *Attorney, Agent, or Firm*—Strasburger & Price LLP

(57) ABSTRACT

A link for a wristband for coupling with other like links comprises a link segment having a forward end and a rear end. The rear end defines a first slot and the forward end is minimally smaller than the first slot. The forward end further defines a second slot therein. At least one pin is retained by the rear end of the link segment and extends into the first slot. The at least one pin is positioned to be received in the second slot of the forward end of a like configured link. A door is selectively slidable over the second slot for capturing and retaining the at least one pin of the like configured link.

14 Claims, 2 Drawing Sheets

ADJUSTABLE WRISTBAND LINK

PRIORITY CLAIM

This application claims the benefits of the earlier filed U.S. Provisional App. Ser. No. 60/143,603, filed on Jul. 13, 1999, which is incorporated by reference for all purposes into this application.

BACKGROUND OF THE INVENTION

1. Field of the Invention

This invention is directed to a link assembly for a bracelet, and more particularly to a link assembly for a watch bracelet having an improved coupling arrangement that facilitates easy coupling and uncoupling of links in order to shorten or lengthen the bracelet.

2. Description of the Related Art

Interconnected links for jewelry-type bracelets and bands have been used for many years in the watch industry. Numerous problems arise as a result of the connections between adjacent links when bracelets need to be lengthened or shortened. The bracelet links can be connected by screw fittings where the screw holds the links together and acts as a pivot pin or other rotation point for the links. However, the screws of such assemblies frequently loosen as a result of repeated pivoting, and may fall out, resulting in either loss of the watch or the need for repair. Additionally, a special tool and likely, a trip to the jewelers, is required to adjust the length of the bracelet.

Instead of screws, some interconnected link bracelets use pins fitted into slots or bores in the links, such as the system disclosed in U.S. Pat. No. 4,269,026. Unlike the screw fittings, the pins usually do not have a tendency to loosen or fall out. However, adjusting the bracelet length is still difficult, usually requiring specialized tools and skills.

The ability to provide a wristband link that greatly facilitates rapid and easy adjustment of the wristband to different sizes of wrists is of significant advantage in the retail jewelry sales area. Heretofore, wristbands for watches, bracelets, and other similar jewelry items could be adjusted only by a skilled jeweler or someone with specialized tools to disconnect, remove, and adjust the length of the wristband. Such prior wristband designs are disadvantageous and have many drawbacks in a retail market where customers desire immediate and easy adjustment of their jewelry purchases. Thus there is a need within the industry for a wristband link that is easily adjustable without the need for specialized skill or tooling.

SUMMARY OF THE INVENTION

The present invention is a link for a bracelet that allows for easy adjustment in the length of the bracelet. The link utilizes a coupling pin and slot with a door system which allows for easy adjustment. The coupling pins of a first link couple to the slots of a second link which are covered by doors to securely couple the two links. To uncouple the links, one must only press forward on the spring button that opens the doors covering the slots. With the doors open, coupling pins of the adjoining link can slide out of the slots, uncoupling the links.

One aspect of the present invention is a link for a wristband for coupling with other like links. The link comprises a link segment having a forward end and a rear end. The rear end defines a first slot and the forward end is minimally smaller than the first slot. The forward end further defines a second slot therein. At least one pin is retained by the rear end of the link segment and extends into the first slot. The at least one pin is positioned to be received in the second slot of the forward end of a like configured link. A door is selectively slidable over the second slot for capturing and retaining the at least one pin of the like configured link.

Another aspect of the present invention is s wristband having at least two links. The wristband comprises at least a first link wherein the first link comprises a first link segment defining a rear slot and includes a pin retained in the first link segment and at least partially extending into the rear slot. At least a second link comprises a second link segment having a forward end received in the first slot and further defines a second slot. The second slot receives the pin therein. A door retained by the forward end of the second link is movable between a first open position permitting the insertion of the pin in the second slot and a second closed position retaining the pin in the second slot.

Yet another aspect of the present invention is a method for using an adjustable link for a bracelet. The method comprising the steps of providing a first outer segment that further comprises a first coupling pin; providing a second outer segment that further comprises a second coupling pin; and coupling a center segment to the first and second outer segments, the center segment further comprising a spring button that operatively engages a part of transverse doors that covers a pair of transverse slots.

Still another aspect of the present invention is an adjustable bracelet including at least two adjustable links. The bracelet includes a first adjustable link and a second adjustable link wherein each of the first and second adjustable links comprise a first outer segment further including a first coupling pin and a second outer segment further comprising a second coupling pin. A center segment is coupled to the first and second outer segments. The center segment further comprising a button operatively engaged to a pair of transverse doors that cover a pair of transverse slots. The first coupling pin and the second coupling pin of the first adjustable link operatively couple to the pair of transverse slots of the second link and the pair of transverse doors of the second adjustable link retain the coupling pins in the transverse slots.

These and other advantages of the invention will be further understood and appreciated by those skilled in the art by reference to the following written specification, claims and appended drawings.

DESCRIPTION OF THE INVENTION

Figure 2:
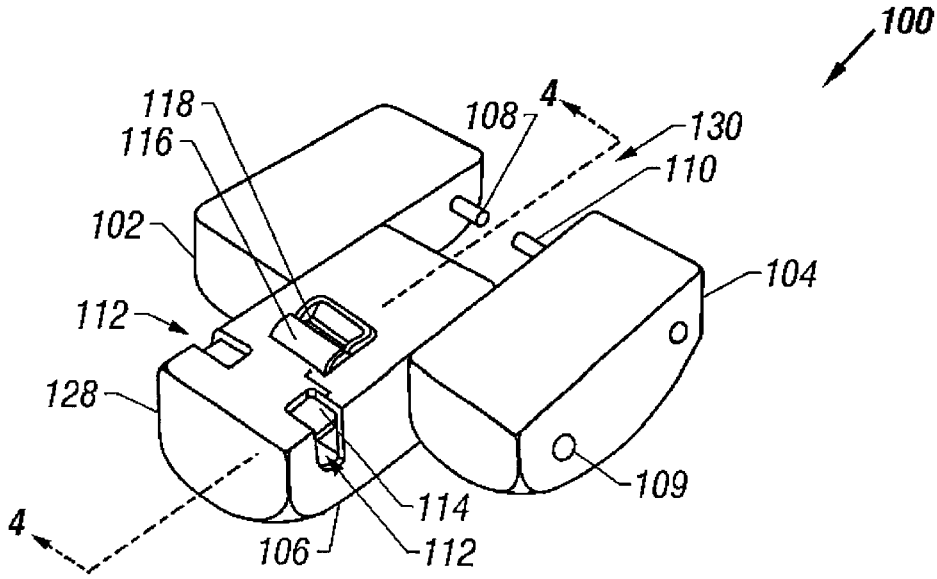
FIG. 2 is a perspective view of an individual link of the wristband of FIG. 1.
Figure 4:
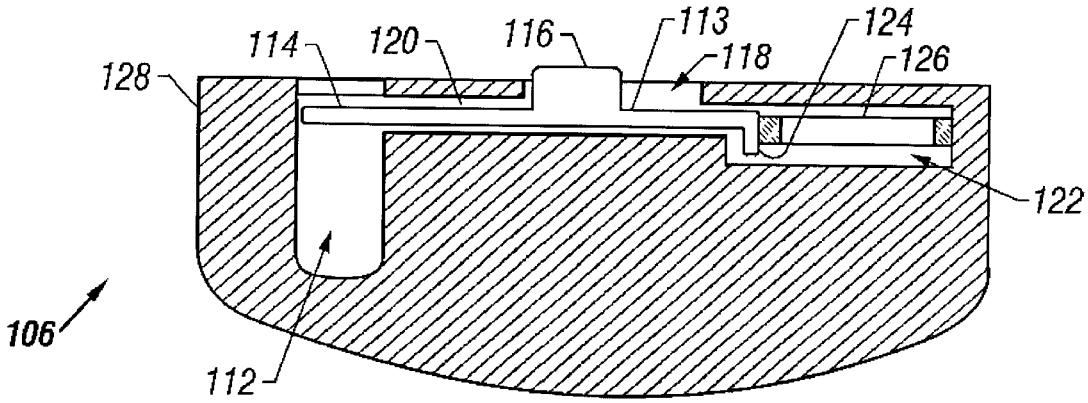
FIG. 4 is a cross-sectional view of the center link segment taken along line IV—IV of FIG. 2, showing the spring biased slide for capturing and retaining the pins of an adjoining link.

For purposes of description herein, the terms "upper", "lower", "right", "left", "rear", "front", "vertical", "horizontal", and derivatives thereof shall relate to the invention as oriented in FIGS. 2 & 4. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting unless the claims expressly state otherwise.

Figure 1:
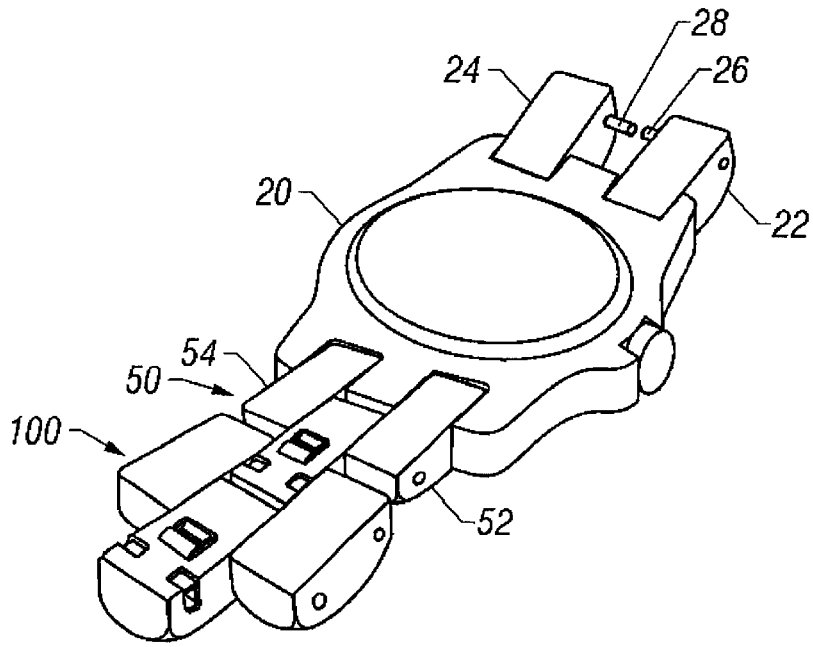
FIG. 1 is a perspective view of the back of a watch incorporating a wristband having individual links according to the preferred embodiment of the present invention.

Turning to the drawings, FIGS. 1–4 show a wristband link 100, which is one of the preferred embodiments of the present invention, and illustrates its various components. FIG. 1 shows a watch 20 as viewed from a back side of the watch and a band comprised of individual links 100 of a preferred embodiment of the present invention.

Turning now to FIG. 2, a single link 100 of the wristband is illustrated. Link 100 comprises three permanently coupled link segments 102, 104 and 106 with the center link segment 106 positioned approximately one-half of a link segment forward from the outer link segments 102 and 104. Link segments 102, 104 and 106 are pivotally joined by pin 109 extending laterally through the three pins such that center segment 106 can pivot with respect to segments 102 and 104. A forward end 128 of link segment 106 extends from the forward end of link 100, and the offset arrangement of link segment 106 from outer link segments 102 and 104 further defines at a rear of link 100, a slot 130 for receiving the forward end 128 of center link segment 106 of a next link 100 in the wristband. As shown in FIGS. 2 and 4, the outer link segments 102 and 104 have coupling pins 108, 110 extending into the slot 130. Pins 108 and 110 are substantially co-axial to facilitate the pivoting of the next link 100 about pins 108 and 110. The center link segment 106 has transverse slots 112 proximate to forward end 128 , as shown in FIG. 2. Slots 112 are covered by doors 114. Doors 114 are opened by pressing rearward on a spring lock button 116 extending through aperture 118 in the back of the center link segment 106. Releasing spring lock button 116 results in the doors 114 closing over the slots 112.

FIG. 4 shows an internal configuration of center link segment 106 in cross-section. Although center link segment 106 is show as being substantially solid, those skilled in the art will appreciate that alternate variations of center link segment are possible as a hollow segment or as a partially solid segment core with a thin outer layer over the core to implement the internal configuration of the center link segment. A slot 112 is located at the forward end 128 of segment 106 and extends downward to a depth sufficient to receive pin 108 or 110 while maintaining a joined links 100 of the wristband in substantially equal vertical alignment one to the other. Slot 112 extends through the back surface of segment 106 thereby facilitating the simultaneous vertical insertion of pins 108 and 110 in slots 112.

A capture slide 113 is slidingly retained within segment 106. Biasing spring 122 is retained in rear cavity 122 of segment 106 and contacts rear surface 124 of slide 113 thereby biasing slide 113 to its normal forward position. Slide 113 includes door 114 retained in forward end cavity 120, with the forward end of door 114 obstructing the upper part of slot 112 such that pins 108 and 110 cannot be vertically removed from slots 112 while slide 113 is in its normally forward biased position. Slide 113 further include button 116 at a mid section thereof. Button 116 extends upward through aperture 118 in the back of segment 106. When slide 113 is biased forward, button 116 is normally positioned at the forward end of aperture 118.

Figure 3:
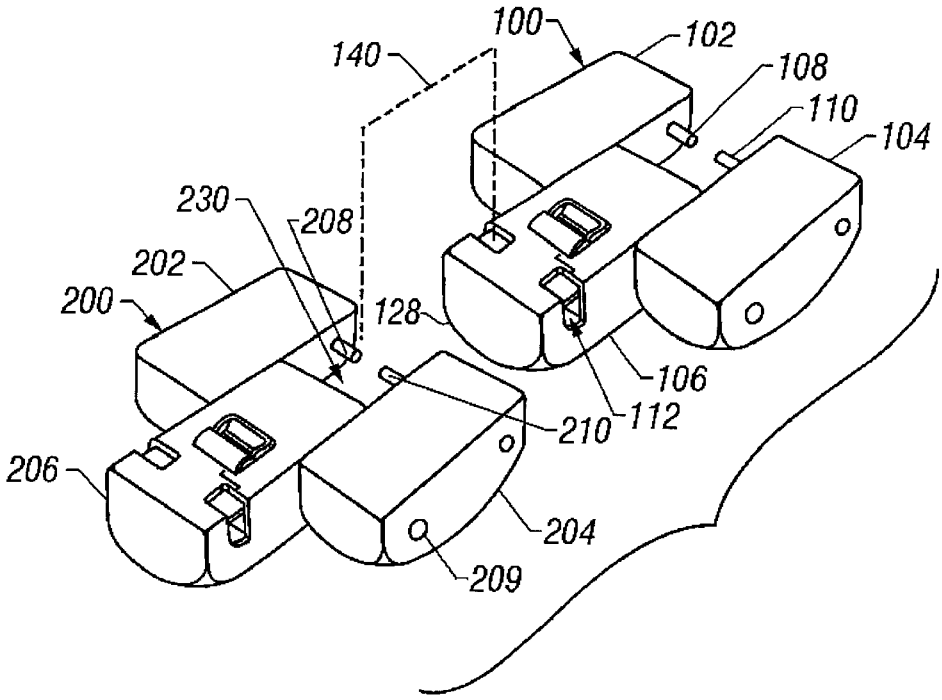
FIG. 3 is a perspective view showing how the links of a preferred embodiment of the present invention attach and detach to each other.

FIG. 3 shows the method for attaching and detaching links. Slide 113 can be translated rearward by applying rearward pressure to button 116 and overcoming the biasing force of spring 126 thereby moving button 116 to the rear portion of aperture 118 and thus retracting door 114 and opening slots 112 for the insertion of pins 108 and 110. The second link 200 is thus attached by vertically inserting pins 208 and 210 of link 200 into slots 112 of link 100 as illustrated by dashed line 140 of FIG. 3 and then releasing button 116. Upon the release of button 116, biasing spring biases slide 113 forward and doors 114 cover slots 112 thereby securely capturing pins 208 and 210 in slots 112 and coupling link 100 to link 200. Links 100 and 200 can be likewise decoupled in a reverse manner by again applying rearward pressure to button 116 thus retracting door 114 from slots 112 and then vertically removing pins 208 and 210 from slots 112.

Referring again to FIG. 1, the figure shows how the links are incorporated into a bracelet attached to a watch 20. The watch 20 has specific attachments 22 and 24 that incorporate portions of the preferred embodiment of the link 100. Attachments 22 and 24 are comprised of outer link segments of link 100. Attachments 22 and 24 have coupling pins 26, 28 extending into the space between the two portions. These coupling pins 26, 28 allow for attachment of other links 100 thereto. The bottom attachment 50 to the watch 20 is composed of outer segments 52 and 54 which attach to the watch 20. A center segment 56 joins these outer segments 52 and 54. The center segment 56 is the same as center link segment 106 in the preferred embodiment of the link 100 and operated in the same manner to receive and retain pins 108 and 110 of a link 100.

While FIGS. 1–4 show the link segments in a rectangular embodiment, those skilled in the art will recognize that the present invention could be practiced in other interconnecting link designs, such a those having a "V" shaped or "U" shaped links.

In the foregoing description, those skilled in the art will readily appreciate that modifications may be made to the invention without departing from the concepts disclosed herein. Such modifications are to be considered as included in the following claims, unless these claims expressly state otherwise.

We claim:

1. A link for a wristband to be coupled with other like links, said link comprising:

a link segment having a forward end and a rear end, said rear end defining a first slot and a forward end minimally smaller than said first slot, said forward end further defining a second slot therein;

at least one pin retained by said rear end of said link segment and extending into said first slot, said at least one pin positioned to be received in the second slot of the forward end of a like configured link; and a door selectively slidable over said second slot for capturing and retaining said at least one pin of the like configured link.

2. The link according to claim 1 wherein said door is retained within said link segment.

3. The link according to claim 2 wherein said link segment further includes an aperture, and said door further includes a button protruding through said aperture for sliding said door between said open position and said closed position.

4. The link according to claim 3 wherein said door is normally biased to a closed position.

5. The link according to claim 4 further comprising a spring biasing said door to said closed position.

6. The link according to claim 5 wherein said spring is housed within an internal cavity defined by said link.

7. A wristband having at least two links, said wristband comprising:

least a first link wherein said first link comprises a first link segment defining a rear slot and further comprising a pin retained in said first link segment and at least partially extending into said rear slot; and at least a second link wherein said second link comprises a second link segment having a forward end, said forward end received in said first slot and further defining a second slot, said second slot receiving said pin therein; and a door retained by said forward end of said second link, said door movable between a first open position permitting the insertion of said pin in said second slot and a second closed position retaining said pin in said second slot.

8. A wristband according to claim 7 wherein said door is retained within said forward end of said second link.

9. A wristband according to claim 8 wherein said forward end of said second link defines an aperture, and said door further includes a button protruding through said aperture for sliding said door between said open position and said closed position.

10. A wristband according to claim 9 wherein said door is normally biased to a closed position.

11. A wristband according to claim 10, said forward end of said second link further comprises a spring biasing said door to said closed position.

12. A wristband according to claim 11 wherein said spring is housed within an internal cavity defined by said forward end of said second link.

13. A method for using an adjustable link for a bracelet, comprising:

providing a first outer segment that further comprises a first coupling pin;

providing a second outer segment that further comprises a second coupling pin; and coupling a center segment to said first and second outer segments, said center segment further comprising a spring button that operatively engages a part of transverse doors that covers a pair of transverse slots.

14. An adjustable bracelet including at least two adjustable links, comprising:

a first adjustable link and a second adjustable link wherein each of said first adjustable link and second adjustable link comprise:

a first outer segment further comprising a first coupling pin;

a second outer segment further comprising a second coupling pin;

a center segment coupled to said first and second outer segments, said center segment further comprising a button, said button operatively engages a pair of transverse doors that covers a pair of transverse slots; and wherein said first coupling pin and said second coupling pin of said first adjustable link operatively couple to said pair of transverse slots of said second link and said pair of transverse doors of said second adjustable link retain said coupling pins in said transverse slots.

* * * * *